US008043445B2

(12) United States Patent
Benedictus et al.

(10) Patent No.: US 8,043,445 B2
(45) Date of Patent: Oct. 25, 2011

(54) HIGH-DAMAGE TOLERANT ALLOY PRODUCT IN PARTICULAR FOR AEROSPACE APPLICATIONS

(75) Inventors: Rinze Benedictus, Delft (NL); Christian Joachim Keidel, Montabaur (DE); Alfred Ludwig Heinz, Neiderahr (DE); Hinrich Johannes Wilhelm Hargarter, Flensburg (DE)

(73) Assignee: Aleris Aluminum Koblenz GmbH, Koblenz (DE)

( * ) Notice: Subject to any disclaimer, the term of this patent is extended or adjusted under 35 U.S.C. 154(b) by 612 days.

(21) Appl. No.: 10/855,560

(22) Filed: May 28, 2004

(65) Prior Publication Data

US 2005/0081965 A1 Apr. 21, 2005

Related U.S. Application Data

(60) Provisional application No. 60/476,199, filed on Jun. 6, 2003.

(30) Foreign Application Priority Data

Jun. 6, 2003 (EP) ..... 03076779

(51) Int. Cl.
*C22C 21/12* (2006.01)
*C22F 1/057* (2006.01)

(52) U.S. Cl. ..... 148/417; 420/532; 420/539; 420/553; 148/693; 148/701

(58) Field of Classification Search ..... 148/417, 148/693, 701, 700; 420/532, 533, 539.553
See application file for complete search history.

(56) References Cited

U.S. PATENT DOCUMENTS 3,637,441 A 1/1972 Lyle, Jr. et al.
(Continued)

FOREIGN PATENT DOCUMENTS

EP 0829552 3/1998
(Continued)

OTHER PUBLICATIONS

"Aluminum and Aluminum Alloys", ASM International, 1993, p. 20-21.*

(Continued)

*Primary Examiner* — Roy King
*Assistant Examiner* — Janelle Morillo
(74) *Attorney, Agent, or Firm* — Novak Druce + Quigg, LLP

(57) ABSTRACT

The invention relates to an aluminium alloy wrought product with high strength and fracture toughness and high fatigue resistance and low fatigue crack growth rate, and having a composition for the alloy comprising, in weight %, about 0.3 to 1.0% magnesium (Mg), about 4.4 to 5.5% copper (Cu), about 0 to 0.20% iron (Fe), about 0 to 0.20% silicon (Si), about 0 to 0.40% zinc (Zn), and Mn in a range 0.15 to 0.8 as a dispersoids forming element in combination with one or more of dispersoids forming elements selected from the group consisting of: (Zr, Sc, Cr, Hf, Ag, Ti, V), in ranges of: about 0 to 0.5% zirconium (Zr), about 0 to 0.7% scandium (Sc), about 0 to 0.4% chromium (Cr), about 0 to 0.3% hafnium (Hf), about 0 to 0.4% titanium (Ti), about 0 to 1.0% silver (Ag), the balance being aluminium (Al) and other incidental elements, and whereby there is a limitation of the Cu—Mg content such that $-1.1[Mg]+5.38 \leqq [Cu] \leqq 5.5$. The invention further relates to a method of manufacturing such a product.

24 Claims, 5 Drawing Sheets

Mg-Cu diagram setting out the Cu-Mg range for the alloy according to this invention, together with narrower preferred ranges

U.S. PATENT DOCUMENTS

| | | | | |
|---|---|---|---|---|
| 3,826,688 | A | 7/1974 | Levy | |
| 4,772,342 | A | 9/1988 | Polmear | |
| 5,376,192 | A | 12/1994 | Cassada, III | |
| 5,512,112 | A | 4/1996 | Cassada, III | |
| 5,593,516 | A * | 1/1997 | Cassada, III | 148/418 |
| 5,652,063 | A | 7/1997 | Karabin | |
| 5,879,475 | A * | 3/1999 | Karabin | 148/417 |
| 6,569,542 | B2 | 5/2003 | Warner et al. | |
| 7,704,333 | B2 * | 4/2010 | Cho et al. | 148/417 |
| 2001/0006082 | A1 | 7/2001 | Warner et al. | |
| 2003/0207141 | A1 | 11/2003 | Warner et al. | |

FOREIGN PATENT DOCUMENTS

| | | | |
|---|---|---|---|
| EP | 0989195 | | 3/2000 |
| EP | 1114877 | | 7/2001 |
| ES | 2175647 | T | 11/2002 |
| RU | 1625043 | A1 | 10/1995 |
| SU | 664570 | A | 5/1979 |
| WO | 9405820 | | 3/1994 |

OTHER PUBLICATIONS

Lakhtin Yu. M. et al., Material Science, Moscow, "Machine Construction," 1980, p. 40.

* cited by examiner

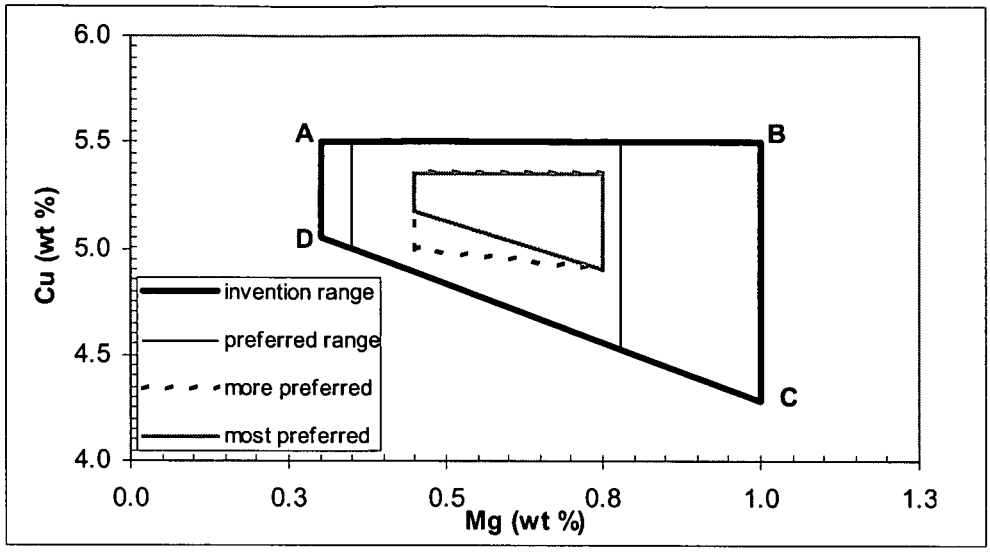
Fig. 1: Mg-Cu diagram setting out the Cu-Mg range for the alloy according to this invention, together with narrower preferred ranges

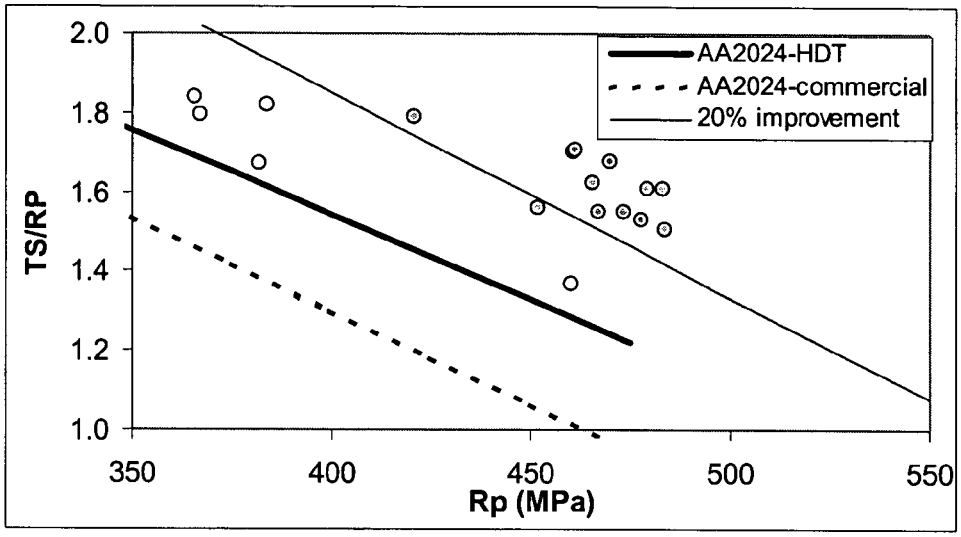
Fig. 2a: Tensile (L) versus toughness (L-T) of the results of Table 3
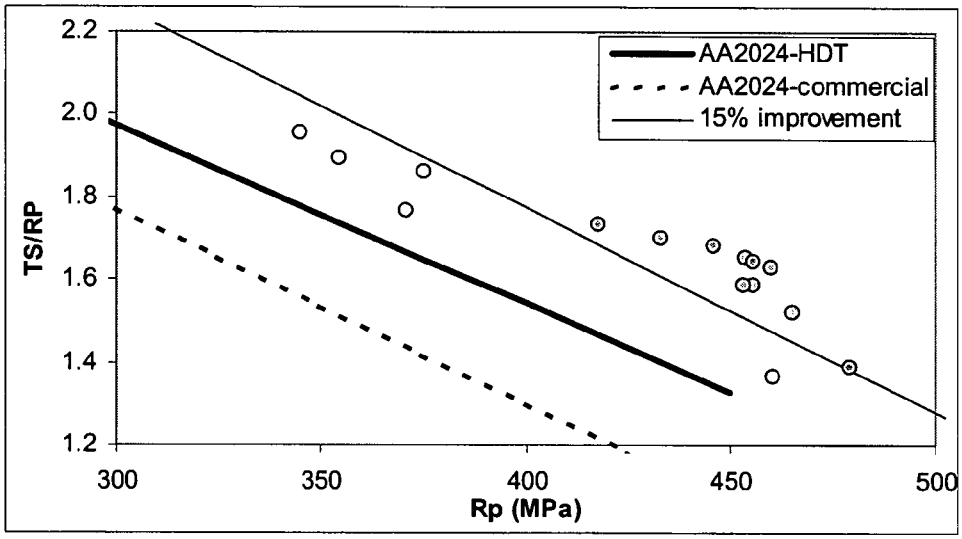
Fig. 2b: Tensile (LT) versus toughness (T-L) of the results of Table 3

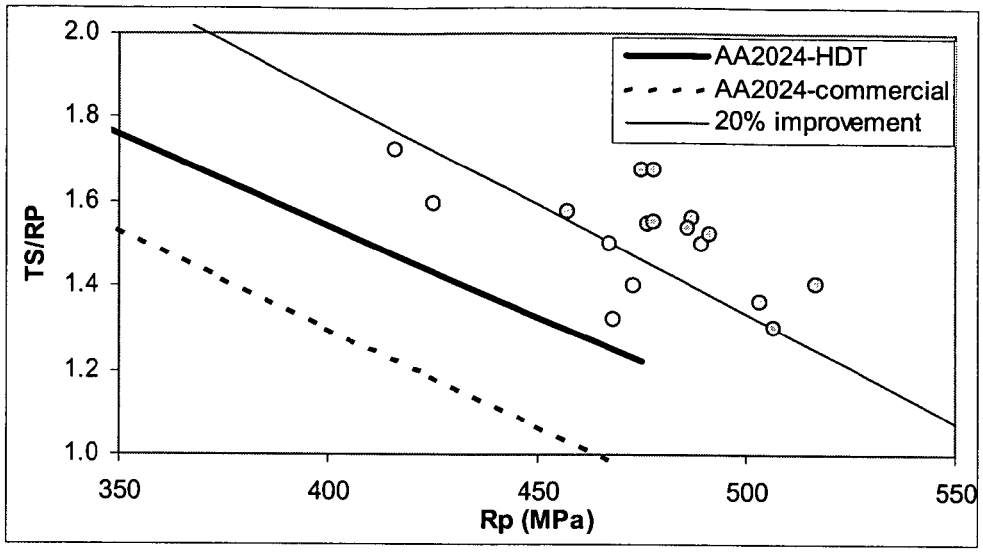
Fig. 3a: Tensile (L) versus toughness (L-T) of the results of Table 4
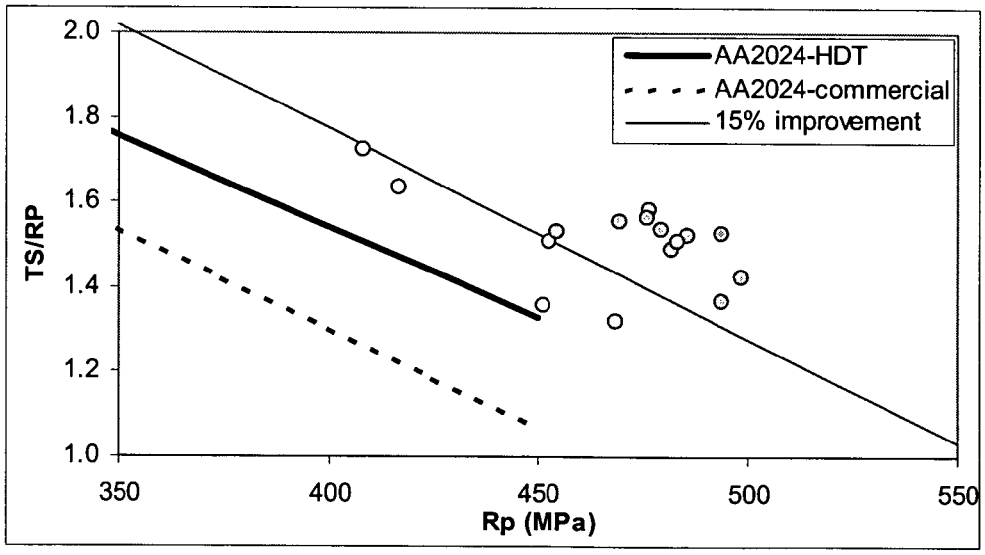
Fig. 3b: Tensile (LT) versus toughness (T-L) of the results of Table 4

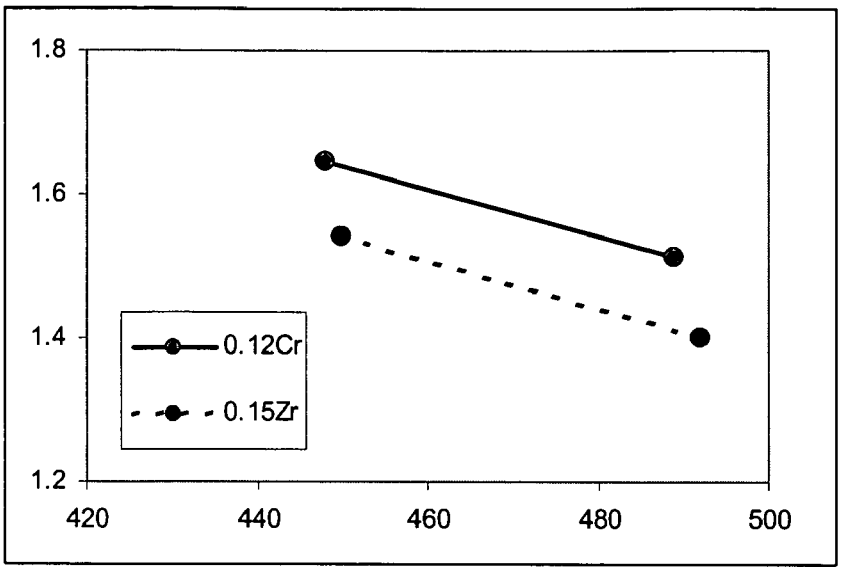
Fig. 4: Tensile (LT) versus toughness (T-L) of alloy 19 and 20
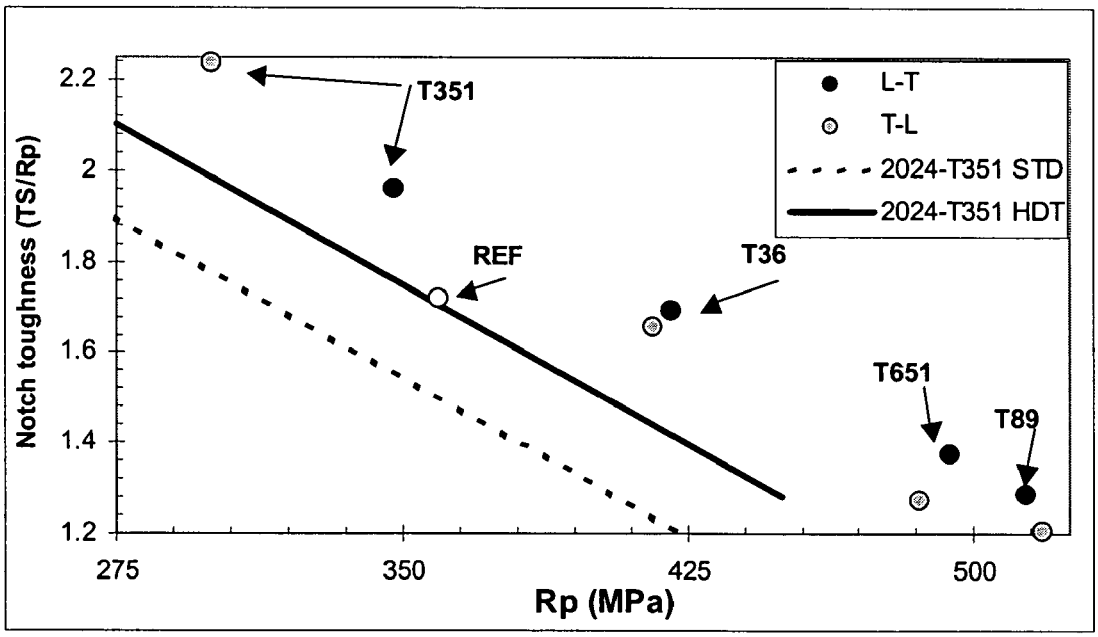
Fig. 5. The results of Example 3

Fig. 6: FCGR of various tempers in the L-T direction vs. HDT 2024-T351 material.
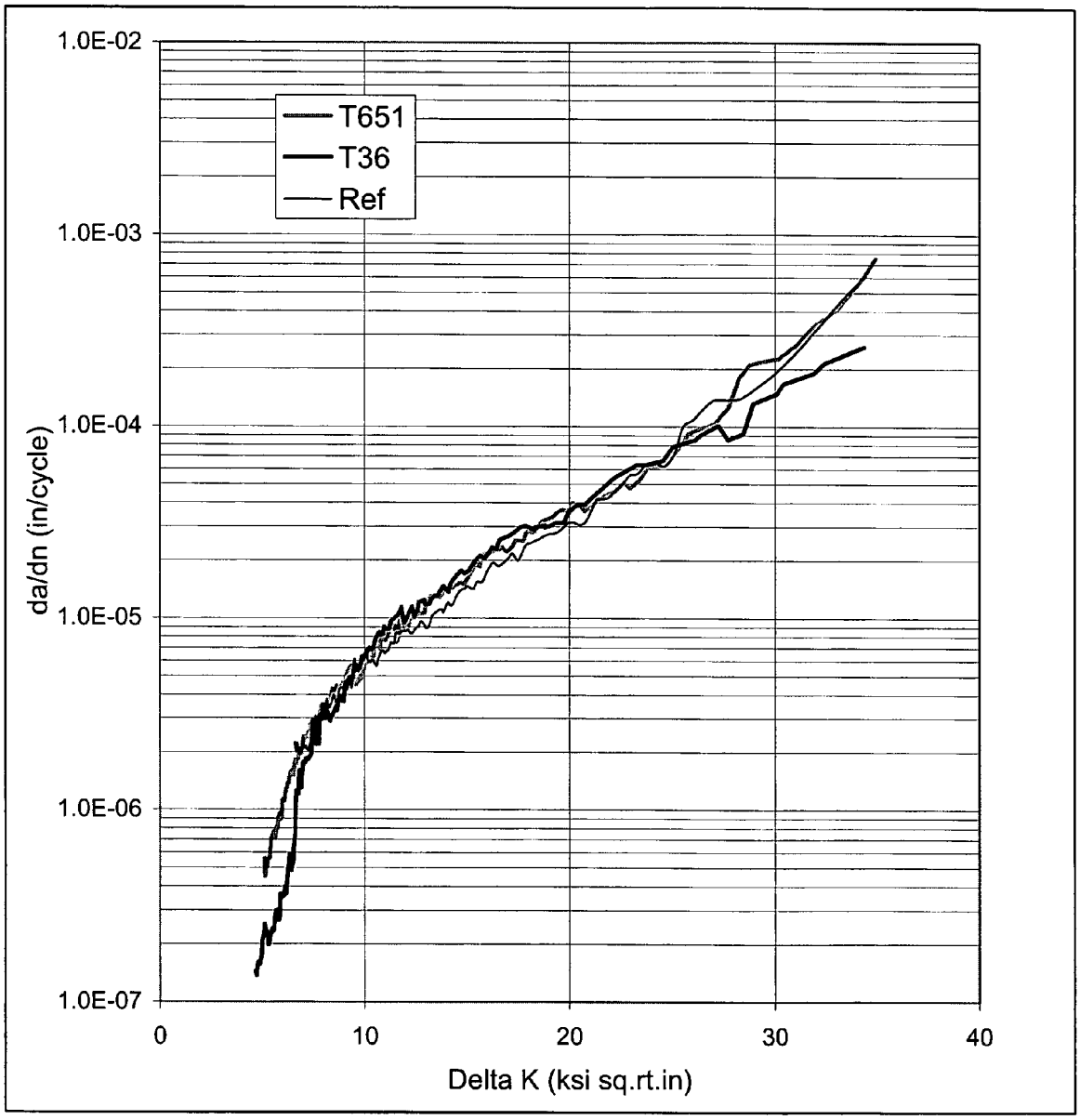

HIGH-DAMAGE TOLERANT ALLOY PRODUCT IN PARTICULAR FOR AEROSPACE APPLICATIONS

CROSS-REFERENCE TO RELATED APPLICATIONS

This claims priority from European patent application No. 03076779.2, filed on Jun. 6, 2003 and U.S. Provisional patent application 60/476,199 filed on Jun. 6, 2003 both of which are incorporated herein by reference in their entirety.

FIELD OF THE INVENTION

The invention relates to an aluminium alloy, particular an Al—Cu—Mg type (or 2000-series aluminium alloys as designated by the Aluminum Association). More specifically, the present invention is related to an age-hardenable, high strength, high fracture toughness and low crack growth propagation aluminium alloy and products of that alloy. Products made from this alloy are very suitable for aerospace applications, but not limited to that. The alloy can be processed to various product forms (e.g. sheet, thin plate, thick plate or extruded or forged products). The aluminium alloy can be uncoated or coated or plated with another aluminium alloy in order to improve even further the properties, for example corrosion resistance.

BACKGROUND OF THE INVENTION

Designers and manufacturers in the aerospace industry are constantly trying to improve fuel efficiency, product performance and constantly trying to reduce the manufacturing and service costs. Efficiency can be improved by further weight reduction. One way of obtaining this is by improving the relevant material properties, so that the structure made from that alloy can be designed more effectively or will have overall a better performance. By having better material properties, also the service cost can be significant reduced by longer inspection intervals of the aeroplane. Lower wing plates are typically made from AA2324 in the T39 temper. For fuselage skin, typically AA2024 in the T351 temper was used. This because these alloy in these temper showed the requested material properties under tensile loading, i.e. acceptable strength levels, high toughness and low crack growth propagation. Nowadays, new more efficient aeroplanes are designed, leading to wish for improved material properties.

U.S. Pat. No. 5,652,063 discloses an AA2000-series alloy with a Cu/Mg ratio between 5 and 9 and strength of more than 531 MPa. The alloy can be used both for lower wing plate and for fuselage skin. This alloy is particularly intended for supersonic aircraft.

U.S. Pat. No. 5,593,516 discloses an AA2000-series alloy wherein the copper (Cu) and magnesium (Mg) levels are kept preferably below the solubility limit. Preferably, [Cu]=5.2−0.91[Mg]. In U.S. Pat. Nos. 5,376,192 and 5,512,112, originating from the same initial US patent application, the addition of silver (Ag) levels of 0.1-1.0 weight % has been disclosed.

U.S. patent application US2001/0006082 discloses an M2000-series alloy especially suitable for the lower wing, without dispersoid forming elements like Zirconium (Zr), Chromium (Cr), or Vanadium (V). It is mentioned also that advantages are achieved by a mandatory Cu/Mg ratio of above 10.

For new designed aeroplanes, there is a wish for even better properties than the above-described alloys have, in order to design more cost and environmental effective aeroplanes. Accordingly, a need exist for an aluminium alloy capable of achieving the improved proper property balance in the relevant product form.

SUMMARY OF INVENTION

It is an object of the present invention to provide an aluminium alloy wrought product, in particular suitable for aerospace application, within the AA2000-series alloys and having a balance of high strength and fracture toughness and high fatigue resistance and low fatigue crack growth rate, which is at least comparable to those of AA2024-HDT.

It is yet another object of the present invention to provide a method of manufacturing such an aluminium alloy wrought product.

The present invention is directed to an AA2000-series aluminium alloy having the capability of achieving a property balance in any relevant product that is better than the property balance of the variety of commercial aluminium AA2000-series alloys nowadays used for those products or aluminium AA2000 disclosed so far.

The object is achieved by provided a composition for the alloy of the present invention which consists essentially of, in weight %, about 0.3 to 1.0% magnesium (Mg), about 4.4 to 5.5% copper (Cu), about 0 to 0.20% iron (Fe), about 0 to 0.20% silicon (Si), about 0 to 0.40% zinc (Zn), and Mn in a range 0.15 to 0.8 as dispersoids forming element in combination with one or more of dispersoids forming elements selected from the group consisting of: (Zr, Sc, Cr, Hf, Ag, Ti, V), in ranges of: about 0 to 0.5% zirconium (Zr), about 0 to 0.7% scandium (Sc), about 0 to 0.4% chromium (Cr), about 0 to 0.3% hafnium (Hf), about 0 to 0.4% titanium (Ti), about 0 to 1.0% silver (Ag), the balance being aluminium (Al) and other incidental elements, and wherein there is a limitation of the Cu—Mg content such that: $-1.1[Mg]+5.38 \leqq [Cu] \leqq 5.5$.

In a preferred embodiment the ranges of Cu and Mg are selected such that:

Cu about 4.4 to 5.5,

Mg about 0.35 to 0.78, and wherein $-1.1[Mg]+5.38 \leqq [Cu] \leqq 5.5$.

In a more preferred embodiment the ranges of Cu and Mg are selected such that: Cu about 4.4 to 5.35, Mg about 0.45 to 0.75, and wherein $-0.33[Mg]+5.15 \leqq [Cu] \leqq 5.35$.

In a more preferred embodiment the ranges of Cu and Mg are selected such that: Cu about 4.4 to 5.5, and preferably about 4.4 to 5.35, Mg about 0.45 to 0.75, and wherein $-0.9[Mg]+5.58 \leqq [Cu] \leqq 5.5$, and more preferably $-0.90[Mg]+5.60 \leqq [Cu] \leqq 5.35$ Much to our surprise we found that the dispersoid forming elements are as critical for the property balance as are the Cu and Mg levels on itself. Zn may be present in the alloy of this invention. In order to get optimised properties, the Mn levels have to be chosen very carefully with respect to the Ag level. When Ag is present in the alloy, the Mn level should not be too high, preferably below 0.4 wt %. Zr should also not be too high. We found that Cr, believed to have a negative effect on the property balance, does actually have a positive effect, but then preferably no Zr is present in the alloy. When this dispersoid-effect is taken into account, the optimised Cu and Mg levels are different from what has been used so far. Surprisingly, the property balance of the present alloy does outperform the existing alloys.

Iron can be present in a range of up to 0.20%, and preferably is kept to a maximum of 0.10%. A typical preferred iron level would be in the range of 0.03 to 0.08%.

Silicon can be present in a range of up to 0.20%, and preferably is kept to a maximum of 0.10%. A typical preferred silicon level would as low a possible, and would typically be for practical reasons in a range of 0.02 to 0.07%.

Zinc can be present in the alloy according to the invention in an amount of up to 0.40%. More preferably it is present in a range of 0.10 to 0.25%.

Impurity elements and incidental elements can be present according to the standard AA rules, namely each up to 0.05%, total 0.15%.

Mn addition is important in the alloy according to the invention as a dispersoid forming element, and should be in a range of 0.15 to 0.8%. A preferred maximum for the Mn addition is less than 0.40%. A more suitable range for the Mn addition is in the range of 0.15 to <0.40%, and more preferably of 0.20 to 0.35%, and most preferably of 0.25 to 0.35%.

If added the Zr addition should not exceed 0.5%. A preferred maximum for the Zr level is 0.18%. And a more suitable range of the Zr level is a range of 0.06 to 0.15%.

In an embodiment the alloy is substantially Zr free, but would in that case contain Cr, and typically Cr in a range of 0.05 to 0.30%, and preferably in a range of 0.06 to 0.15%.

If added the Ag addition should not exceed 1.0%, and a preferred lower limit is 0.1%. A preferred range for the Ag addition is 0.20-0.8%. A more suitable range for the Ag addition is in the range of 0.20 to 0.60%, and more preferably of 0.25 to 0.50%, and most preferably in a range of 0.32 to 0.48%.

Furthermore, the dispersoids forming elements Sc, Hf, Ti and V can be used in the given ranges. In a more preferred embodiment the alloy product according to the invention is substantially free from V, e.g. at a levels of <0.005% and more preferably absent. The Ti can be added also to obtain a grain refining effect during the casting operation at levels known in the art. For the purpose of this specification the terms "substantially free" and" essentially free" mean that no purposeful addition of such alloying element was made to the composition, but that due to impurities and/or leaching from contact with manufacturing equipment, trace quantities of such element may, nevertheless, find their way into the final alloy product.

In a particular embodiment of the wrought alloy product according to this invention, the alloy consists essentially of, in weight percent:

Mg 0.45 to 0.75, and typically about 0.58
Cu 4.5 to 5.35, and typically about 5.12
Zr 0.0 to 0.18, and typically about 0.14
Mn 0.15 to 0.40, and typically about 0.3
Ag 0.20 to 0.50, and typically about 0.4
Zn 0 to 0.25, and typically about 0.12
Si <0.07, and typically about 0.04
Fe <0.08, and typically about 0.06
Ti <0.02, and typically about 0.01
balance aluminium and unavoidable impurities.

In another particular embodiment of the wrought alloy product according to this invention, the alloy consists essentially of, in weight percent:

Mg 0.45 to 0.75, and typically about 0.62
Cu 4.5 to 5.35, and typically about 5.1
substantially Zr free, typically less then 0.01
Cr 0.05 to 0.28, and typically about 0.12
Mn 0.15 to 0.40, and typically about 0.3
Ag 0.20 to 0.50, and typically about 0.4
Zn 0 to 0.25, and typically about 0.2
Si <0.07, and typically about 0.04
Fe <0.08, and typically about 0.06
Ti <0.02, and typically about 0.01
balance aluminium and unavoidable impurities.

In another particular embodiment of the wrought alloy product according to this invention, the product is preferably processed to a T8 temper, and the alloy consists essentially of, in weight percent:

Mg 0.65 to 1.1, and typically about 0.98
Cu 4.5 to 5.35, and typically about 4.8
Zr 0.0 to 0.18, and typically about 0.14
Mn 0.15 to 0.40, and typically 0.3
Ag 0.20 to 0.50, and typically 0.4
Zn 0 to 0.25, and typically about 0.2
Si <0.07, and typically about 0.04
Fe <0.08, and typically about 0.06
Ti <0.02, and typically about 0.01
balance aluminium and unavoidable impurities.

The alloy according to the invention can be prepared by conventional melting and may be cast into suitable ingot form, e.g., by means of direct chill, D.C.-casting. Grain refiners based on Ti, such as for example titanium boride or titanium carbide may also be used. After scalping and possible homogenisation, the ingots are further processed by, for example extrusion or forging or hot rolling in one or more stages. This processing may be interrupted for an inter-anneal. Further processing may be cold working, which may be cold rolling or stretching. The product is solution heat treated and quenched by immersion in or spraying with cold water or fast cooling to a temperature lower than 95° C. The product can be further processed, for example rolling or stretching, for example up to 12%, or may be stress relieved by stretching or compression and/or aged to a final or intermediate temper. The product may be shaped or machined to the final or intermediate structure, before or after the final ageing or even before solution heat treatment.

BRIEF DESCRIPTION OF THE DRAWINGS

FIG. 1 is an Mg—Cu diagram setting out the Cu—Mg range for the alloy according to this invention, together with narrower preferred ranges;

FIGS. 2(*a*) and 2(*b*) show a diagram of tensile strength versus toughness in two test directions for the alloy according to this invention in a T651 temper in comparison with prior art 2024 alloys;

FIGS. 3(*a*) and 3(*b*) show a diagram of tensile strength versus toughness in two test directions for the alloy according to this invention in a T89 temper in comparison with prior art 2024 alloys;

FIG. 4 shows the tensile strength versus toughness of two alloys according to this invention as function of the Cr- and Zr-content;

FIG. 5 shows the yield strength versus the notch toughness of the alloy according to this invention for two test directions in various tempers in comparison with known prior art 2024 alloys;

FIG. 6 shows the FCGR (fatigue crack growth rate) of the alloy according to this invention in two tempers in comparison with the prior art alloy HDT-AA2024-T351.

DETAILED DESCRIPTION OF THE INVENTION

The design of commercial aircraft requires different sets of properties for different types of structural parts. The important material properties for a fuselage sheet product are the damage tolerant properties under tensile loads (i.e. FCGR, fracture toughness and corrosion resistance).

The important material properties for a lower wing skin in a high capacity and commercial jet aircraft are similar to those for a fuselage sheet product, but typically a higher tensile strength is desired by the aircraft manufacturers. Also, fatigue life becomes a major material property for this application.

The important material properties for machined parts from thick plate depends on the final machined part. But, in general, the gradient in material properties through thickness must be small and the engineering properties like strength, fracture toughness, fatigue and corrosion resistance must be a high level.

The present invention is directed to an alloy composition when processed to a variety of products, such as, but not limited to, sheet, plate, thick plate, etc., will meet or exceed the currently desired material properties. The property balance of the product will out-perform the property balance of the product made from nowadays commercially used alloys for this type of application, in particular those of standard AA2024 and AA2024-HDT. A chemistry window within the AA2000 window that does fulfil this unique capability has been very surprisingly found.

The present invention resulted from an investigation on the effect of dispersoid levels and types (e.g. Zr, Cr, Sc, Mn), and combined with Cu and Mg on the phases and microstructure formed during processing. Some of these alloys were processed to sheet and plate and tested on tensile, Kahn-tear toughness and corrosion resistance. Interpretations of these results lead to the surprising insight that an aluminium alloy produced with a chemical composition within a certain window, will exhibit excellent damage tolerant properties as well as for sheet as for plate as for thick plate as for extrusions as for forgings, allowing it to be a multi-purpose alloy product. The alloy product also has good weldability characteristics.

The invention also includes that the alloy wrought product of this invention may be provided on one or both sides with a cladding or coating. Such clad or coated products utilise a core of the aluminium base alloy of the invention and a cladding of usually higher purity which in particular corrosion protects the core, which is of particular advantage in aerospace applications. The cladding includes, but is not limited to, substantially unalloyed aluminium or aluminium containing not more than 0.1 or 1% of all other elements. Aluminium alloys herein designated 1xxx-type series include all Aluminium Association (AA) alloys, including the subclasses of the 1000-type, 1100-type, 1200-type and 1300-type. Thus, the cladding on the core may be selected from various Aluminium Association alloys such as 1060, 1045, 1100, 1200, 1230, 1135, 1235, 1435, 1145, 1345, 1250, 1350, 1170, 1175, 1180, 1185, 1285, 1188, 1199, or 7072. In addition, alloys of the AA7000-series alloys, such as 7072 containing zinc (0.8 to 1.3%), can serve as the cladding and alloys of the AA6000-series alloys, such as 6003 or 6253, which contain typically more than 1% of alloying additions, can serve as cladding. Other alloys could also be useful as cladding as long as they provide in particular sufficient overall corrosion protection to the core alloy. The cladding can also be an aluminium alloy selected from the AA4000-series, and may serve for corrosion protection and can also be of assistance in a welding operation, e.g. as disclosed in U.S. Pat. No. 6,153,854 (incorporated herein by reference), where the use of additional filler wire can be omitted. The cladding layer or layers are usually much thinner than the core, each constituting 1 to 15% or 20% or possibly 25% of the total composite thickness. A cladding or coating layer more typically constitutes around 1 to 11% of the total composite thickness.

In another aspect of the invention there is provided a method of manufacturing the aluminium alloy product according to the invention into a structure element. The method of manufacturing a high-strength, high-toughness and low fatigue crack growth rate AA2000-series alloy product, having a good corrosion resistance, comprises the processing steps of:

a.) casting an ingot having a composition as set out in the present description and claims;

b.) homogenising and/or pre-heating the ingot after casting;

c.) hot working the ingot into a pre-worked product;

d.) optionally reheating the pre-worked product and either, e.) hot working and/or cold working to a desired formed workpiece;

f.) solution heat treating said formed workpiece at a temperature and time sufficient to place into solid solution substantially all soluble constituents in the alloy;

g.) quenching the solution heat treated workpiece by one member of the group consisting of spray quenching or immersion quenching in water or other quenching media;

h.) optionally stretching or compressing the quenched workpiece or otherwise cold working the quenched workpiece to relieve stresses, for example levelling of sheet products;

i.) optionally ageing the quenched and optionally stretched or/and compressed workpiece to achieve a desired temper, for example, the tempers T3, T351, T36, T3x, T4, T6, T6x, T651, T87, T89, T8x.

j.) optionally followed by machining of the product formed until the final shape of the structure element.

The alloy products of the present invention are conventionally prepared by melting and may be direct chill (D.C.) cast into ingots or other suitable casting techniques. Homogenisation treatment is typically carried out in one or multi steps, each step having a temperature in the range of 460 to 535° C. The pre-heat temperature involves heating the rolling ingot to the hot-mill entry temperature, which is typically in a temperature range of 400 to 460° C. Hot working the alloy product can be done by one of rolling, extruding or forging. For the current alloy hot rolling is preferred. Solution heat-treatment is typically carried out within the same temperature range as used for homogenisation, although the soaking times can be chosen somewhat shorter.

A surprisingly excellent property balance is obtained over a wide range of thickness. In the sheet thickness range of up to 0.5 inch (12.5 mm) the properties will be excellent for fuselage sheet. In the thin plate thickness range of 0.7 to 3 inch (17.7 to 76 mm) the properties will be excellent for wing plate, e.g. lower wing plate. The thin plate thickness range can be used also for stringers or to form an integral wing panel and stringer for use in an aircraft wing structure. When processed to thicker gauges of more than 2.5 inch (63 mm) up to about 11 inch (280 mm) excellent properties have been obtained for integral parts machined from plates, or to form an integral spar for use in an aircraft wing structure, or in the form of a rib for use in an aircraft wing structure. The thicker gauge products can be used also as tooling plate, e.g. moulds for manufacturing formed plastic products, for example via die-casting or injection moulding. The alloy products according to the invention can also be provided in the form of a stepped extrusion or extruded spar for use in an aircraft structure, or in the form of a forged spar for use in an aircraft wing structure.

FIG. 1 shows schematically the ranges for the Cu and Mg for the alloy according to the present invention in their various embodiments as set out in dependent claims. The ranges can also be identified by using the corner-points A, B, C, and D of a box. Preferred ranges are identified by A' to D', and more preferred ranges by A" to D", and most preferred ranges by A'" to D'". The coordinates are listed in Tables 1 and 1A.

TABLE 1

Coordinates (in wt. %) for the corner-points of the Cu—Mg ranges for the preferred ranges of the alloy product according to the invention.

| Corner point | (Mg, Cu) wide range | Corner point | (Mg, Cu) preferred range |
|---|---|---|---|
| A | 0.3, 5.50 | A' | 0.35, 5.50 |
| B | 1.0, 5.50 | B' | 0.78, 5.50 |
| C | 1.0, 4.28 | C' | 0.78, 4.99 |
| D | 0.3, 5.05 | D' | 0.35, 4.52 |

TABLE 1A

Coordinates (in wt. %) for the corner-points of the Cu—Mg ranges for the preferred ranges of the alloy product according to the invention.

| Corner point | (Mg, Cu) more preferred | Corner point | (Mg, Cu) most preferred |
|---|---|---|---|
| A" | 0.45, 5.35 | A'" | 0.45, 5.35 |
| B" | 0.75, 5.35 | B'" | 0.75, 5.35 |
| C" | 0.75, 4.90 | C'" | 0.75, 4.92 |
| D" | 0.45, 5.00 | D'" | 0.45, 5.20 |

EXAMPLES

Example 1

On a laboratory scale 18 alloys were cast to prove the principle of the current invention and processed to 4.0 mm sheet. The alloy compositions are listed in Table 2, for all ingots Fe=0.07, Si=0.05, Ti=0.02, balance aluminium. Rolling blocks of approximately 80 by 80 by 100 mm (height×width×length) were sawn from lab cast ingots of about 12 kg. The ingots were homogenised with a two-step homogenisation treatment, i.e., about 10 hrs at 520° C. followed by 10 hrs at 525-530° C. The heating to the homogenisation temperature was done slowly. After the homogenisation treatment the blocks were consequently slowly air cooled to mimic an industrial homogenisation process. The rolling ingots were pre-heated for about 6 hours at 460±5° C. At an intermediate thickness range of about 40 to 50 mm the blocks were reheated at 460±5° C. The blocks were hot rolled to the final gauge of 4.0 mm. During the whole hot-rolling process, care was taken to mimic an industrial scale hot rolling. The hot-rolled products were solution heat treated and quenched. The sheets were processed to the appropriate temper. Stretching level was between 0 to 9%, depending on the final temper. The final products were peak aged or near peak aged strength (e.g. T6x or T8x temper respectively).

Tensile properties have been tested according EN10.002. The tensile specimens from the 4 mm thick sheet were flat EURO-NORM specimens with 4 mm thickness. The tensile test results in Table 3 and 4 are from the L- and LT-direction. The Kahn-tear toughness is tested according ASTM B871-96, and the test direction of the results on Table 3 and 4 is the T-L and L-T direction. The so-called notch-toughness can be obtained by dividing the tear-strength, obtained by the Kahn-tear test, by the tensile yield strength ("TS/Rp"). This typical result from the Kahn-tear test is known in the art to be a good indicator for true fracture toughness. The unit propagation energy ("UPE"), also obtained by the Kahn-tear test, is the energy needed for crack growth. It is commonly believed that the higher the UPE, the more difficult to grow the crack, which is a desired feature of the material.

The alloys from Table 2 were processed to sheet according the above described processing route. Finally the alloys were aged to the T651 temper (stretched 1.5% and aged for 12 h/175° C.). The results are shown in Table 3 and in FIGS. 2*a*, 2*b*.

In FIGS. 2*a*, 2*b* the results of standard AA2024 are given as a reference. The tensile versus toughness of commercially available AA2024 for fuselage application and the tensile versus toughness of high damage tolerant ("HDT") AA2024 (e.g. AA2524) are given as references. The closed individual points are alloys according to the invention, whereas the open individual points are alloys not according to this invention. The present invention shows in the L versus L-T at least a 15% improvement in toughness over the HDT-AA2024, and the best results show even a 20% or more improvement. The skilled person will immediately recognize that the values for the 2024-commercial and 2024-HDT at the top left hand represent typically values for the T3 tempers, whereas the bottom right hand side represent values for the T6 and T8 tempers.

From the results is can also be seen that, with carefully balancing the Ag level, the dispersoids levels and the Cu and Mg levels, a unprecedented improvement in the toughness versus tensile properties can be obtained.

Sheets from the same alloy were also produced to the T8 temper. In Table 4 and FIGS. 3*a*, 3*b* the results of the T89 temper are shown in a similar manner as for FIGS. 2*a* and 2*b*. In FIGS. 3*a*, 3*b* the results of AA2024 are given again as a reference. The tensile versus toughness of commercial available AA2024 for fuselage application and the tensile versus toughness of high damage tolerant (HDT) AA2024 (e.g. AA2524) are given as reference. The present invention shows in the L versus L-T at least a 15% improvement in toughness over the HDT-AA2024, and the best results show even 20% or more improvement.

From the results is can also be seen that, with carefully balancing the Ag level, the dispersiods levels, and the Cu and Mg levels, a unprecedented improvement in the toughness versus tensile properties can be obtained.

Note that alloy 16 in the T8 temper show an impressive tensile versus toughness balance, whereas in the T6 temper this alloy was a close, but just below the target of 20% improvement. It is believed that the slightly less performance of this alloy in the T6 temper is the resultant of experimental scatter in the laboratory scale experiment.

TABLE 2

Chemistry of alloys cast on a laboratory scale.
With 0.06 wt. % Fe and 0.04 wt. % Si and 0.02 wt. % Ti

| Specimen number | Invention Alloy (yes/no) | Cu (wt %) | Mg (wt %) | Mn (wt %) | Ag (wt %) | Zn (wt %) | Zr (wt %) | Other (wt %) |
|---|---|---|---|---|---|---|---|---|
| 1 | no | 5.6 | 0.45 | 0.30 | 0.44 | 0.41 | 0.13 | — |
| 2 | yes | 5.1 | 0.55 | 0.30 | 0.40 | <0.01 | 0.15 | — |
| 3 | yes | 5.1 | 0.55 | 0.29 | 0.40 | 0.38 | 0.15 | — |
| 4 | no | 5.2 | 0.56 | 0.31 | <0.01 | 0.61 | 0.15 | — |
| 5 | yes | 5.1 | 0.55 | 0.30 | 0.40 | 0.20 | 0.16 | — |
| 6 | yes | 4.9 | 0.62 | 0.30 | 0.39 | 0.20 | 0.14 | — |
| 7 | yes | 5.0 | 0.61 | 0.30 | 0.40 | 0.11 | 0.15 | — |
| 8 | yes | 5.1 | 0.63 | 0.31 | 0.25 | 0.21 | 0.15 | — |
| 9 | yes | 5.0 | 0.61 | 0.30 | 0.40 | 0.21 | <0.01 | 0.12 Cr |
| 10 | yes | 5.0 | 0.63 | <0.01 | 0.40 | 0.21 | 0.15 | — |
| 11 | no | 5.0 | 0.64 | <0.01 | <0.01 | 0.21 | <0.01 | 0.12 Cr |
| 12 | yes | 5.0 | 0.42 | 0.31 | 0.40 | 0.21 | 0.15 | — |
| 13 | yes | 5.0 | 0.83 | 0.28 | 0.41 | 0.21 | 0.15 | — |
| 14 | no | 5.3 | 0.22 | 0.31 | 0.39 | 0.21 | 0.15 | — |
| 15 | yes | 5.4 | 0.62 | 0.30 | 0.40 | 0.21 | 0.15 | — |
| 16 | yes | 4.8 | 0.98 | 0.28 | 0.40 | 0.21 | 0.15 | — |
| 17 | yes | 4.6 | 0.80 | 0.30 | 0.39 | 0.20 | 0.15 | — |
| 18 | no | 5.2 | 0.62 | 0.30 | <0.01 | <0.01 | 0.14 | 0.20 Ge |

TABLE 3

Mechanical properties of the alloys tested in the T651 temper, ("—" means not measured)

| | Invention | L | | | L-T | | LT | | | T-L | |
|---|---|---|---|---|---|---|---|---|---|---|---|
| Specimen number | Alloy (yes/no) | Rm (MPa) | Rp (MPa) | ELONG. A5 (%) | TS/Rp | UPE (kJ/m2) | Rm (MPa) | Rp (MPa) | ELONG. A5 (%) | TS/Rp | UPE (kJ/m2) |
| 1 | no | 507 | 461 | 13 | 1.37 | 126 | 507 | 461 | 13 | 1.37 | 126 |
| 2 | yes | 517 | 480 | 9 | 1.61 | 351 | 503 | 456 | 11 | 1.59 | 176 |
| 3 | yes | 517 | 484 | 11 | 1.61 | 314 | 505 | 460 | 9 | 1.63 | 147 |
| 4 | no | 462 | 384 | 16 | 1.82 | 302 | 462 | 376 | 16 | 1.86 | 210 |
| 5 | yes | 512 | 474 | 13 | 1.55 | 333 | 501 | 454 | 11 | 1.65 | 132 |
| 6 | yes | 509 | 470 | 10 | 1.68 | 378 | 500 | 456 | 10 | 1.64 | 196 |
| 7 | yes | 507 | 466 | 12 | 1.62 | 328 | 493 | 447 | 8 | 1.68 | 152 |
| 8 | yes | 509 | 461 | 12 | 1.70 | 334 | 493 | 443 | 8 | — | — |
| 9 | yes | 505 | 467 | 12 | 1.55 | 311 | 490 | 434 | 12 | 1.70 | 204 |
| 10 | yes | 503 | 462 | 9 | 1.71 | 303 | 501 | 454 | 12 | 1.59 | 165 |
| 11 | no | 450 | 382 | 13 | 1.67 | 206 | 451 | 371 | 12 | 1.77 | 206 |
| 12 | yes | 469 | 421 | 12 | 1.79 | 398 | 479 | 418 | 12 | 1.73 | 210 |
| 13 | yes | 518 | 478 | 12 | 1.53 | 225 | 518 | 466 | 11 | 1.52 | 129 |
| 14 | no | 441 | 366 | 15 | 1.84 | 311 | 440 | 355 | 11 | 1.89 | 190 |
| 15 | yes | 527 | 484 | 13 | 1.50 | 236 | 516 | 480 | 10 | 1.39 | 100 |
| 16 | yes | 500 | 452 | 13 | 1.56 | 257 | 490 | 432 | 12 | — | — |
| 17 | yes | 496 | 452 | 13 | 1.52 | 306 | 484 | 430 | 12 | 1.53 | 161 |
| 18 | no | 450 | 367 | 18 | 1.80 | 408 | 444 | 345 | 14 | 1.95 | 205 |

TABLE 4

Mechanical properties of the alloys tested in the T89 temper, ("—" means not measured)

| | Invention | L | | | L-T | | LT | | | T-L | |
|---|---|---|---|---|---|---|---|---|---|---|---|
| Specimen number | Alloy (yes/no) | Rm (MPa) | Rp (MPa) | ELONG. A5 (%) | TS/Rp | UPE (kJ/m2) | Rm (MPa) | Rp (MPa) | ELONG. A5 (%) | TS/Rp | UPE (kJ/m2) |
| 1 | no | 511 | 469 | 13 | 1.32 | 78 | 511 | 469 | 13 | 1.32 | 78 |
| 2 | yes | 509 | 475 | 12 | 1.68 | 403 | 513 | 477 | 5 | 1.58 | 201 |
| 3 | yes | 515 | 490 | 11 | 1.50 | 341 | 519 | 480 | 5 | 1.53 | 141 |
| 4 | no | 499 | 468 | 14 | 1.50 | 333 | 496 | 453 | 7 | 1.51 | 155 |
| 5 | yes | 508 | 478 | 12 | 1.67 | 310 | 514 | 477 | 6 | 1.57 | 141 |
| 6 | yes | 504 | 477 | 13 | 1.55 | 380 | 507 | 470 | 5 | 1.55 | 205 |
| 7 | yes | 505 | 478 | 10 | 1.55 | 312 | 509 | 455 | 5 | 1.53 | 143 |
| 8 | yes | 510 | 487 | 10 | 1.56 | 263 | 512 | 482 | 5 | 1.49 | 139 |

TABLE 4-continued

Mechanical properties of the alloys tested in the T89 temper, ("—" means not measured)

| | Invention | L | | | | | LT | | | | | L-T | | | | | T-L | | | | |
|---|---|---|---|---|---|---|---|---|---|---|---|---|---|---|---|---|---|---|---|---|---|
| Specimen number | Alloy (yes/no) | Rm (MPa) | Rp (MPa) | ELONG. A5 (%) | TS/Rp | UPE (kJ/m2) | Rm (MPa) | Rp (MPa) | ELONG. A5 (%) | TS/Rp | UPE (kJ/m2) | Rm (MPa) | Rp (MPa) | ELONG. A5 (%) | TS/Rp | UPE (kJ/m2) |
| 9 | yes | 516 | 486 | 12 | 1.54 | 308 | 523 | 486 | 6 | 1.52 | 170 | | | | | |
| 10 | yes | 519 | 492 | 13 | 1.52 | 271 | 518 | 484 | 5 | 1.51 | 168 | | | | | |
| 11 | no | 506 | 474 | 8 | 1.40 | 143 | 486 | 452 | 6 | 1.36 | 93 | | | | | |
| 12 | yes | 488 | 458 | 14 | 1.58 | 302 | 496 | 453 | 6 | — | — | | | | | |
| 13 | yes | 536 | 507 | 9 | 1.30 | 238 | 541 | 499 | 5 | 1.42 | 116 | | | | | |
| 14 | no | 473 | 416 | 15 | 1.72 | 332 | 477 | 417 | 7 | 1.63 | 195 | | | | | |
| 15 | yes | 531 | 504 | 12 | 1.36 | 144 | 531 | 494 | 6 | 1.37 | 110 | | | | | |
| 16 | yes | 534 | 517 | 10 | 1.40 | 152 | 531 | 494 | 6 | 1.52 | 117 | | | | | |
| 17 | yes | 526 | 503 | 9 | 1.42 | 129 | 512 | 473 | 6 | 1.45 | 115 | | | | | |
| 18 | no | 469 | 426 | 15 | 1.59 | 291 | 463 | 409 | 7 | 1.72 | 195 | | | | | |

Example 2

Two further alloys have been cast and processed and tested as given in Example 1. The chemistry of the two alloys is shown in Table 5. The final gauge was 4.0 mm. The sheets from these alloys have been aged to T651 and T89 temper. The tensile and Kahn-tear samples have been machined from two sides to a final thickness of 2.0 mm before testing. The test results of these sheets are given in Table 6 and FIG. 4.

Example 2 demonstrates that a Cr containing alloy, in contrast to general belief, can have very high toughness as well. Surprisingly, the Cr-containing alloy 20 does outperform alloy the Zr-containing alloy 19.

TABLE 5

Chemical composition of two alloys according this invention, with Fe = 0.06, Si = 0.04, Ti = 0.02

| Specimen number | Invention Alloy (yes/no) | Cu (wt %) | Mg (wt %) | Mn (wt %) | Ag (wt %) | Zn (wt %) | Zr (wt %) | Other (wt %) |
|---|---|---|---|---|---|---|---|---|
| 19 | yes | 5.05 | 0.62 | 0.38 | 0.47 | 0.21 | 0.15 | — |
| 20 | yes | 5.09 | 0.62 | 0.29 | 0.42 | 0.21 | <0.01 | 0.12 Cr |

TABLE 6

Properties of alloy 20 and 21 of Table 5 in the LT (T-L) direction

| Specimen number | Temper | Rm | Rp | ELONG. | TS/Rp | UPE |
|---|---|---|---|---|---|---|
| 19 | T651 | 499 | 450 | 10 | 1.54 | 160 |
| | T89 | 524 | 492 | 4 | 1.40 | 112 |
| 20 | T651 | 493 | 448 | 12 | 1.64 | 204 |
| | T89 | 525 | 489 | 6 | 1.51 | 170 |

Example 3

Full-size rolling ingots with a thickness of 440 mm were produced on an industrial scale by DC-casting and having the chemical composition (in wt. %): 0.58% Mg, 5.12% Cu, 0.14% Zr, 0.29% Mn, 0.41% Ag, 0.12% Zn, 0.01% Ti, 0.04% Si and 0.06% Fe, balance aluminium and unavoidable impurities. One of these ingots was scalped, homogenised at 2 to 6 hrs/490° C.+24 hrs/520° C.+air cooled to ambient temperature. The ingot was then pre-heated at 6 hrs/460° C. and then hot rolled to about 5 mm. The plate was further cold rolled to 4.0 mm. The plate was then cut in several pieces. The plates were then solutionied at 525° C. for 45 min and consequently water quenched. The plates were 1.5% (T351 and T651) or 6% (T36) or 9% (T89) stretched to obtain the desired temper. The artificial aged tempers (T651 and T89) were aged for 12 hrs at 175° C.

The tensile and Kahn-tear sample were taken from the middle of the plate and tested according the specification as given in Example 1. The FCGR has been measured on 100 mm C(T) specimens according ASTM E647. The R-ratio was 0.1 and the testing was done with constant load.

Open hole fatigue (Kt=3.0) and flat notched fatigue (Kt=1.2) performance was measured according ASTM E466. The specimens were taken from mid-thickness of the plate and machined to a thickness of 2.5 mm. The applied stress was 138 MPa (gross section stress basis) for the open hole specimen and 207 MPa (net section at notch root stress basis) for the flat notched specimens. The test frequency did not exceed 15 Hz. The R-ratio was 0.1. A minimum of 5 specimens per alloy/temper was measured. The tests were terminated when 1,500,000 cycles were achieved. This is commonly called "run-out". A high damage tolerant AA2024-T351 was added as a reference. Results are shown in Table 7 and FIG. 5. From FIG. 5 it can be seen that the high toughness found in the laboratory scale experiments can also be obtained through industrial scale processing.

The fatigue performance of this alloy in the T36 and T89 temper are shown in Table 8. It can be clearly seen that the inventive alloy significantly out-performs the reference HDT 2024-T351.

The FCGR can be seen in FIG. 6. The inventive alloy performs similar to high damage tolerant AA2024-T351 used as a reference.

TABLE 7

Property test results of Example 3.

| | T351 | T651 | T89 | T36 | REF |
|---|---|---|---|---|---|
| Rp (L) | 319 | 494 | 514 | 421 | 360 |
| Rp (LT) | 297 | 486 | 518 | 416 | 332 |
| Rm (L) | 458 | 534 | 518 | 474 | 471 |
| RM (LT) | 458 | 531 | 539 | 470 | 452 |
| Elong (L) | 24 | 10 | 11 | 17 | 18 |
| Elong (LT) | 24 | 10 | 10 | 18 | 18 |
| TS/Rp (L-T) | 1.96 | 1.37 | 1.29 | 1.69 | 1.72 |
| TS/RP (T-L) | 2.24 | 1.27 | 1.21 | 1.66 | — |

TABLE 8

The fatigue performance of the alloy (L-T direction) according this invention in two tempers versus AA2024-HDT as a reference

| | T89 | T36 | REF |
|---|---|---|---|
| Kt = 3.0 | run-out | run-out | $1.2 \times 10^5$ |
| Kt = 1.2 | — | $2.8 \times 10^5$ | $1.2 \times 10^5$ |

Having now fully described the invention, it will be apparent to one of ordinary skill in the art that many changes and modifications can be made without departing from the spirit or scope of the invention as herein described.

The invention claimed is:

1. An aluminium alloy wrought product with high strength and fracture toughness and high fatigue resistance and low fatigue crack growth rate, said alloy consisting of, in weight %:

Cu and Mg in a range which falls within a graphical box defined by the corner points:

Corner point A is 0.45 wt % Mg, 5.35 wt. % Cu,
Corner point B is 0.75 wt % Mg, 5.35 wt. % Cu,
Corner point C is 0.75 wt % Mg, 5.0 wt. % Cu,
Corner point D is 0.45 wt % Mg, 5.20 wt. % Cu, Fe <0.20,
Si <0.20,
Zn about 0.38 to <0.4,
Ag 0.32-0.48, and Mn in a range of 0.15 to 0.31 and Cr in a range of 0.05 to 0.30 as dispersoid forming element elements in combination with one or more optional dispersoids forming elements selected from the group consisting of:

Sc <0.7,
Hf <0.3,
Ti <0.4,
V<0.4, and the balance being aluminium and other impurities or incidental elements, wherein the alloy is substantially free of Zr.

2. An aluminium alloy wrought product according to claim 1, wherein the Mn-content is in a range of 0.20 to 0.31%.

3. An aluminium alloy wrought product according to claim 1, wherein the Cr-content is in a range of 0.06 to 0.15%.

4. Aluminium alloy wrought product according to claim 1, wherein the product is in the form of a sheet, plate, forging or extrusion for use in an aircraft structure.

5. Aluminium alloy wrought product according to claim 1, wherein the product is fuselage sheet, upper wing plate, lower wing plate, thick plate for machined parts, forging or thin sheet for stringers.

6. Aluminium alloy wrought product according to claim 1, wherein the product is in the form of a plate product having a thickness in the range of 12 to 76 mm.

7. An aluminium alloy wrought product according to claim 1, wherein the alloy product has a temper selected from the group consisting of T3, T351, T352, T36, T3x, T4, T6, T61, T62, ˆT6x, T651, T652, T87, T89, and T8x.

8. An aluminium alloy wrought product according to claim 1, wherein the alloy product is aircraft fuselage sheet.

9. An aluminium alloy wrought product according to claim 1, wherein the alloy product is aircraft lower wing plate.

10. An aluminium alloy wrought product according to claim 1, wherein the alloy product is aircraft upper wing plate.

11. Aluminium alloy wrought product according to claim 1, wherein the alloy product is thick plate having a thickness of 63 to 280 mm for machined structures.

12. An aluminium alloy wrought product according to claim 7, wherein the alloy product is aircraft fuselage sheet.

13. Aluminium alloy wrought product according to claim 7, wherein the alloy product is selected from the group consisting of aircraft lower wing plate and aircraft upper wing plate.

14. An aluminium alloy wrought product according to claim 7, wherein the alloy product is a thick plate having a thickness of 63 to 280 mm for machined structures.

15. An aluminium alloy wrought product according to claim 1, wherein the alloy is substantially free of V to have <0.005% V.

16. An aluminium alloy wrought product according to claim 1, wherein

Cu and Mg is in a range which falls within a graphical box defined by the corner points:

Corner point A is 0.45 wt % Mg, 5.35 wt. % Cu,
Corner point B is 0.75 wt % Mg, 5.35 wt. % Cu,
Corner point C is 0.75 wt % Mg, 5.0 wt. % Cu,
Corner point D is 0.55 wt % Mg, 5.20 wt. % Cu.

17. An aluminium alloy wrought product according to claim 16, wherein the one or more optional dispersoids forming elements is selected from the group consisting of:

Sc <0.7,
Hf <0.3,
Ti <0.4, and
V <0.4.

18. An aluminium alloy wrought product according to claim 1, with the proviso that Cu is not less than 5.09 wt. %, wherein the Mn-content is in a range of 0.20 to 0.31%.

19. An aluminium alloy wrought product according to claim 1, wherein the Zn-content is in a range of 0.38 to <0.4%.

20. An aluminium alloy wrought product according to claim 1, consisting of, in weight %:

Cu and Mg in a range which falls within a graphical box defined by the corner points:

Corner point A is 0.55 wt % Mg, 5.35 wt. % Cu,
Corner point B is 0.75 wt % Mg, 5.35 wt. % Cu,
Corner point C is 0.75 wt % Mg, 5.0 wt. % Cu,
Corner point D is 0.55 wt % Mg, 5.20 wt. % Cu, Fe <0.20,
Si <0.20,
Zn about 0.38 to <0.4%
Ag 0.32 to 0.41%,
Mn in a range of 0.28 to 0.31
Cr in a range of 0.05 to 0.30 and one or more optional dispersoids forming elements selected from the group consisting of:

Sc <0.7,
Hf <0.3,
Ti <0.4,
V <0.4, and the balance being aluminium and other impurities or incidental elements, wherein the alloy is substantially free of Zr.

21. The aluminium alloy wrought product according to claim 1, wherein the Mn-content is in a range of 0.15 to 0.28 wt %.

22. The aluminium alloy wrought product according to claim 1, wherein the Mn-content is in a range of 0.15 to 0.25 wt %.

23. The aluminium alloy wrought product according to claim 1, wherein the Mn-content is in a range of 0.15 to 0.20 wt %.

24. Method of producing a high-strength, high-toughness AA2000-series alloy product having a good damage tolerance performance, comprising the processing steps of:

a) casting an ingot having a composition according to claim 1;

b) homogenising and/or pre-heating the ingot after casting;

c) hot working the ingot into a pre-worked product;

d) optional reheating the pre-worked product and either, e) hot working and/or cold working to a desired workpiece form;

f) solution heat treating said formed workpiece at a temperature and time sufficient to place into solid solution substantially all soluble constituents in the alloy;

g) quenching the solution heat treated workpiece by one of spray quenching or immersion quenching in water or other quenching media;

h) optionally stretching or compressing of the quenched workpiece;

i) ageing the quenched and optionally stretched or compressed workpiece to achieve a desired temper.

* * * * *